US005621999A

United States Patent [19]

Moore

[11] Patent Number: 5,621,999

[45] Date of Patent: Apr. 22, 1997

[54] EXTERNALLY MOUNTABLE LASER SIGHT WITH SLIDE SWITCH

[75] Inventor: Larry Moore, Cottonwood, Ariz.

[73] Assignee: Tac Star Industries, Inc., Cottonwood, Ariz.

[21] Appl. No.: 512,682

[22] Filed: Aug. 8, 1995

Related U.S. Application Data

[63] Continuation-in-part of Ser. No. 364,794, Dec. 27, 1994.

[51] Int. Cl.[6] ..... F41G 1/36

[52] U.S. Cl. ..... 42/103; 362/110; 362/114; 362/205; 362/259

[58] Field of Search ..... 42/103; 362/110, 362/113, 114, 205, 206, 259, 294, 395, 394, 802

[56] References Cited

U.S. PATENT DOCUMENTS

| | | | |
|---|---|---|---|
| 1,375,586 | 4/1921 | Graves | 362/205 |
| 2,074,536 | 3/1937 | Brown | 362/205 |
| 2,203,309 | 6/1940 | Schmid | 362/394 |
| 3,876,970 | 4/1975 | Schweitzer | 362/205 |
| 4,048,489 | 9/1977 | Giannetti | 42/103 |
| 4,388,673 | 6/1983 | Maglica | 362/205 |
| 4,856,218 | 8/1989 | Reynolds, Jr. | 42/103 |
| 5,375,362 | 12/1994 | McGarry et al. | 42/103 |

*Primary Examiner*—Stephen M. Johnson

*Attorney, Agent, or Firm*—Michael A. Lechter; James H. Phillips

[57] ABSTRACT

A light emitting module is attached to one of a pair of separable U-shaped metal clamps that can fit around a weapon trigger guard. The clamps have recesses for retaining elastomeric inserts which contact the trigger guard. The inserts are of inexpensive glass-filled molded plastic rather than machined steel so that a greater variety can be provided at low cost and little value is lost by discarding those not needed for a particular weapon. The greater variety provides a better fit with little or no custom shaping and the elastomeric inserts are much easier to shape if an unusually contoured trigger guard is encountered. A slide switch passes through the clamp and is actuated by either a right or left handed user. The motion of the switch is transverse to the trigger guard and firing direction of the gun.

14 Claims, 9 Drawing Sheets

PRIOR ART

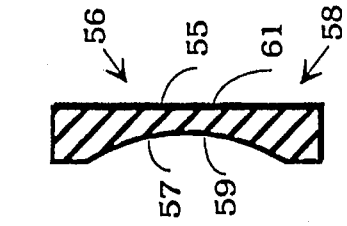
FIG. 18
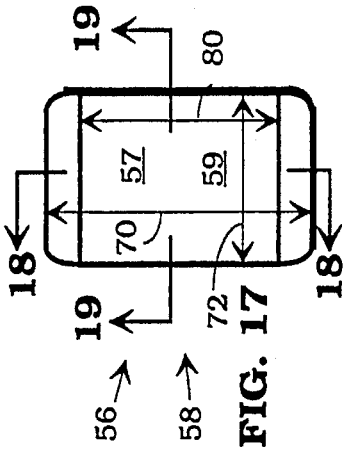
FIG. 17
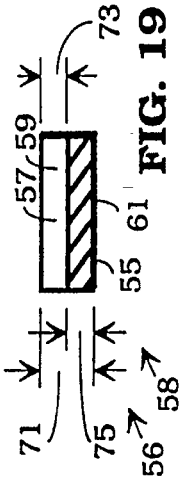
FIG. 19
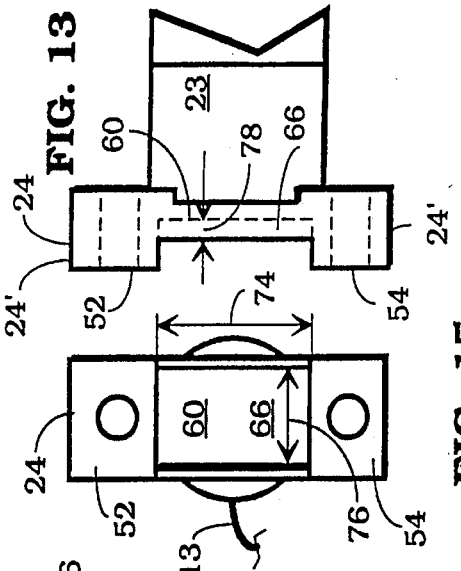
FIG. 13
FIG. 15
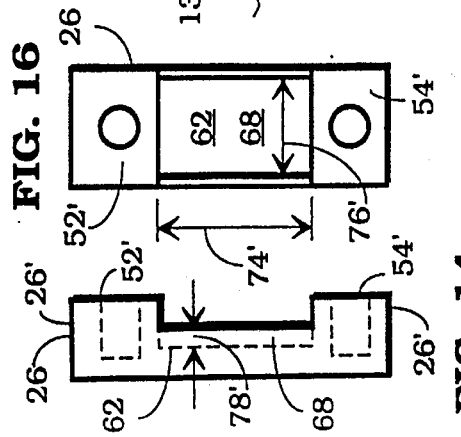
FIG. 16
FIG. 14
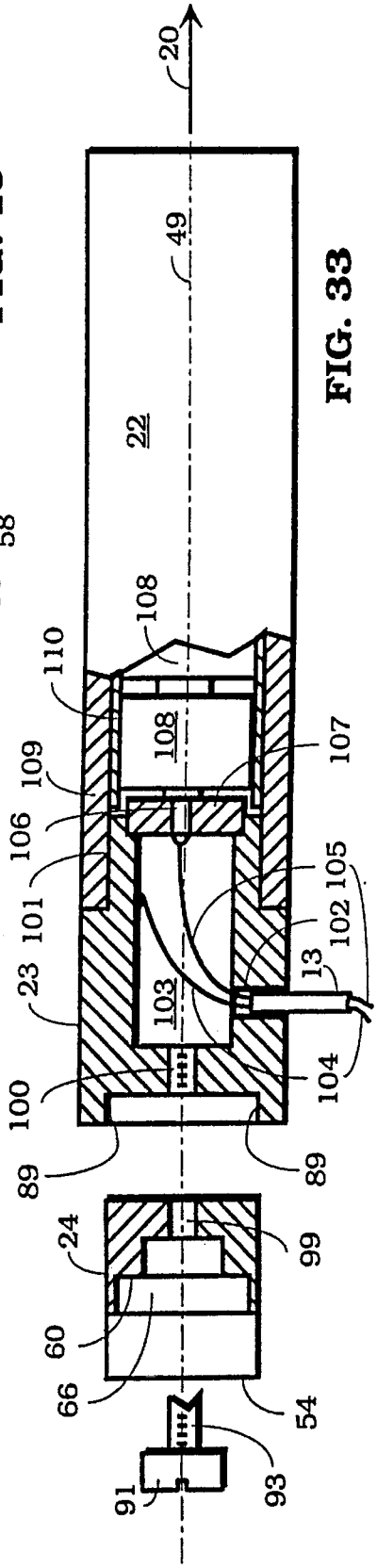
FIG. 33

EXTERNALLY MOUNTABLE LASER SIGHT WITH SLIDE SWITCH

This is a Continuation-In-Part of patent application Ser. No. 08/365,794 filed Dec. 27, 1994.

FIELD OF THE INVENTION

The present invention concerns an externally mountable light emitting module aiming device with an improved mounting mechanism and integral switch, for use with weapons and other applications.

BACKGROUND OF THE INVENTION

It is well known in the art to utilize a light beam as a sighting aid for weapons. An illumination source is provided that projects a narrow beam of light in a direction parallel to the weapon boresight. When the light beam and boresight are properly aligned, the bullet (or other projectile) will hit on or very close to the location of the light beam on the target. Light beam sighting aids are particularly useful at night when ordinary iron or telescopic sights are difficult to use because of low ambient and/or target illumination levels. Light beam sights for weapons are well known in the art.

Lasers are the preferred mechanism of generating light beams for sighting applications. They have comparatively high intensity and can be focused into a narrow beam with a very small divergence angle so that they produce a small, bright light spot on the target tens to hundreds of yards from the light source. Semiconductor light emitting diodes (LEDs) are well known compact light sources that are suitable. As used herein the word "laser" is intended to include any form of light source, and the words "laser sight" are intended to refer to a light emitting module or assembly that projects a beam of light having a small divergence angle suitable for alignment, sighting or pointing purposes. The term "light emitting module" is intended to include an LED or any other type of suitable light source. Light emitting modules for pointing and sighting purposes are well known in the art.

It is known in the art to attach a light emitting module to the trigger guard of a hand gun or other weapon. The battery and other electronics necessary to power an LED may be included within the module or mounted in the butt of the weapon. There are several types of prior art trigger guard mounts. A first type uses two sets of spaced-apart U-shaped clamps. Such a dual-clamp type mount generally provides reasonable stability for the laser sight because it is attached in two spaced-apart locations on the trigger guard. However, a dual-clamp type mount has the disadvantages of being bulkier and more expensive than a single-clamp type of mount.

A second type of mount uses a single U-shaped clamp. Such single-clamp mounts come in several varieties: (i) a custom fitted clamp which is machined to precisely fit a particular weapon, and (ii) a "universal" clamp which is intended to fit a wide variety of weapons. The custom fitted clamp provides reasonable stability for a laser sight but has the disadvantage of being comparatively expensive and only being suitable for the particular weapon trigger guard that it is shaped to fit. The prior art universal, single-clamp mount suffers from a number of disadvantages described below.

A significant practical problem associated with trigger guard mounted laser sights is that trigger guards are complex three-dimensional shapes with non-uniform cross-sections. A trigger guard's function is to prevent accidental discharge of the weapon by inadvertent contact with the trigger. A trigger guard must be smooth so as to not catch on holsters, pockets, trouser waist bands and other locations in which a weapon is carried ready for use. It is these requirements that dictate trigger guard design. Historically, little or no thought has been given to making trigger guards suitable for attachment of a light emitting module since such modules are a comparatively recent development. Classical trigger guard shapes are generally inconvenient for attachment of a light emitting module. A further complication is that different types of weapons have different trigger guard shapes, even guns from the same manufacturer. Thus, it has been difficult to provide a mounting fixture for attaching a laser sight to a trigger guard that is both rugged (i.e., shock and movement resistant) and adaptable to many different types of trigger guards of past, present and future weapons, i.e., a "universal" mount.

Unless custom fitted, prior art universal type, single-clamp trigger guard mounts for laser sights have generally not proved to be sufficiently rugged. It is difficult to maintain alignment of the light emitting module. The shock associated with handling and shooting the weapon is sufficient in many cases to jar the module sufficiently so that the light beam is knocked out of alignment with the weapon boresight. In order to maintain accuracy of the laser sight, it has been necessary to repeatedly remount and/or realign the light emitting module, or to have a skilled gunsmith or machinist custom fit the mount to the desired weapon. Thus, prior art single-clamp trigger guard mounts have not proved well suited for a "do-it-yourself" type of installation, especially one that is adaptable for many trigger guard shapes on different types of guns.

A further problem with prior art arrangements has been the use of electrical switches for turning the laser sight on and off which protrude from the laser sight in such a way as to sometimes interfere with drawing and replacing the weapon in a holster, pocket, waist band or other carrying place.

Thus, there continues to be a need for an improved, externally mounted laser sight for weapons (e.g., hand guns) and other purposes, and especially for a universal type mount which attaches to multiple trigger guards or other structures of complex shape using a single clamp, and further for sights that have a low profile integral on/off switch.

BRIEF DESCRIPTION OF THE FIGURES

Preferred exemplary embodiments of the present invention will hereinafter be described in conjunction with the appended drawing, wherein like designations denote like elements and:

FIGS. 13–14 are side views from the same direction as in FIG. 10, showing parts of the clamping portions of FIG. 10, disassembled and in greater detail;

FIGS. 15–16 are front views showing the interior (facing) surfaces of the clamping portions of FIGS. 13–14;

FIG. 17 is a front view of an insert used in the clamp of FIG. 10;

FIG. 18 is a first cross-section view and FIG. 19 is a second cross-sectional view of the insert of FIG. 17 at the locations shown in FIG. 17;

FIG. 33 is an exploded, partial cross-sectional and cut-away side view of the trigger guard mounting light emitting assembly of the present invention, showing additional details;

DETAILED DESCRIPTION OF THE PREFERRED EMBODIMENT

Figures 1, 2A, 2B, 2C, 2D:
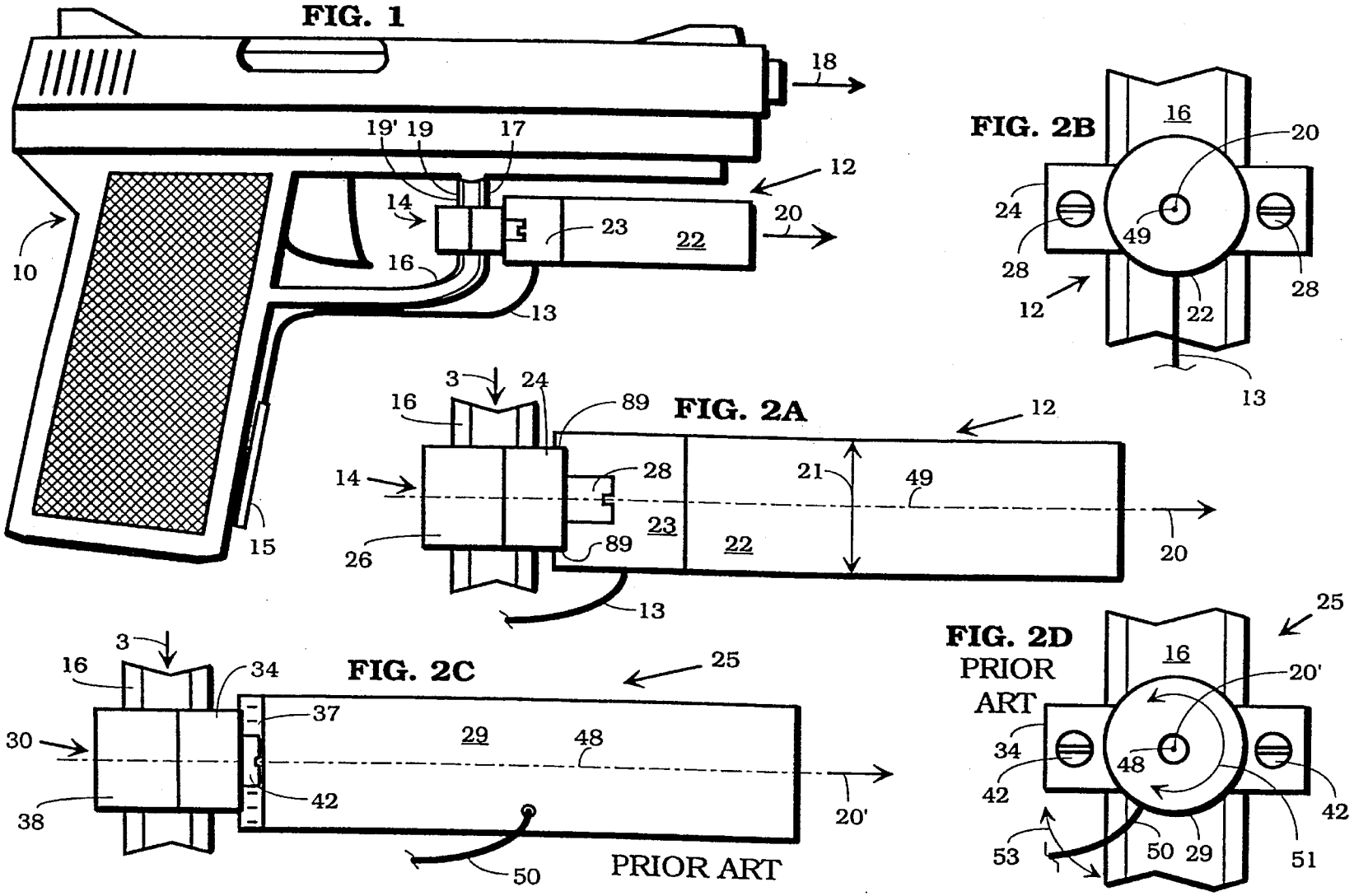
FIG. 2D PRIOR ART
FIG. 1 is a simplified side view of a semi automatic pistol having a trigger guard mounted laser sighting assembly, according to the present invention.
FIG. 2A is a simplified side view of the laser sighting assembly of FIG. 1, showing the mounting arrangement in greater detail.
FIG. 2B is a simplified end view of the laser sighting assembly of FIG. 2A, looking toward the emerging light beam.
FIG. 2C is a simplified side view analogous to FIG. 2A, but of a laser sighting assembly according to the prior art.
FIG. 2D is a simplified end view analogous to FIG. 2B but of the prior art assembly of FIG. 2C.

FIG. 1 is a simplified side view of pistol 10 having light beam emitting assembly 12 according to the present invention. Assembly 12 comprises light emitting module 22 with end portion 23. End portion 23 is attached by single clamp 14 to weapon trigger guard 16. Trigger guard 16 has outward (forward) facing surface 17 and inward (rearward) facing surface 19. Surfaces 17, 19 as well as the other surfaces of trigger guard 16 are generally curved. They can be convex, concave or a combination thereof. Weapon 10 has bullet trajectory or bore sight 18. Assembly 12 with light emitting module 22 emits light beam 20. When assembly 12 with light emitting module 22 is properly aligned, the light spot on a target (not shown) formed by light beam 20 is located substantially at the impact point of a bullet traveling along trajectory 18. Generally, light emitting module 22 is provided with adjustments for windage and drop, however, such details are outside the scope of the present invention. Electrical cord 13 couples light emitting module 22 via end portion 23 to switch 15. Switch 15 is conveniently a pressure type switch that is typically attached to the butt of weapon 10. Squeezing switch 15 when grasping weapon 10 turns on light emitting module 22, thereby causing light beam 20 to be emitted. Light emitting module 22, end portion 23 and clamp 14 are constructed in such a manner that they join together in a predetermined relationship so that cord 13 exits, for example, from the bottom of end portion 23 where it can run along the bottom of trigger guard 16 to switch 15. This reduces the likelihood of snagging cord 13 on the user's holster, clothes or other objects.

FIG. 2A is a simplified side view and. FIG. 2B is a simplified end view of assembly 12 of FIG. 1 in greater detail, according to the present invention. Clamp 14 comprises portions 24, 26. Portion 24 is coupled to end portion 23 of light emitting module 22 and portion 26 is removably attached to portion 24 by screws or other attachment mechanism 28. Trigger guard 16 is captured between clamp portions 24, 26. Clamp portions 24, 26 squeeze directly or indirectly against trigger guard 16, thereby holding light emitting module 22 firmly in the desired position. It has been found that, among other things, the reliability and ruggedness of a trigger guard mounted laser sight depends critically on the design of clamp 14. Assembly 12 has axial centerline 49.

FIG. 2C is a side view analogous to FIG. 2A and FIG. 2D is an end view analogous to FIG. 2B showing prior art single-clamp laser sight assembly 25. Clamp 30 is analogous to clamp 14 and light emitting module 29 is analogous to light emitting module 22. Module 29 emits light beam 20' analogous to light beam 20. Assembly 25 comprises end portion 37 which is removably attached to light emitting module 29 and to first portion 34 of clamp 30. Second portion 38 of clamp 30 is attached to first portion 34 by screws 42 with trigger guard 16 captured therebetween. Electrical cord 50 analogous to cord 13 emerges from the side of module 29 and couples to a switch (not shown) analogous to switch 15.

End portion 37 is knurled to facilitate attachment to and detachment from portion 34 of clamp 30 and light emitting module 29 by axially oriented screw threads (not shown). These screw threads are actuated by relative rotation of the pieces around assembly longitudinal axis 48, as indicated by arrows 51 in FIG. 2D. As a consequence of this arrangement module 29 and cord 50 may have any angular orientation around axis 48 as indicated by arrows 51, 53. There is no fixed angular setting (around axis 48) for module 29 or fixed direction of emergence of cord 50 with respect to trigger guard 16 and gun 10.

Figure 3:
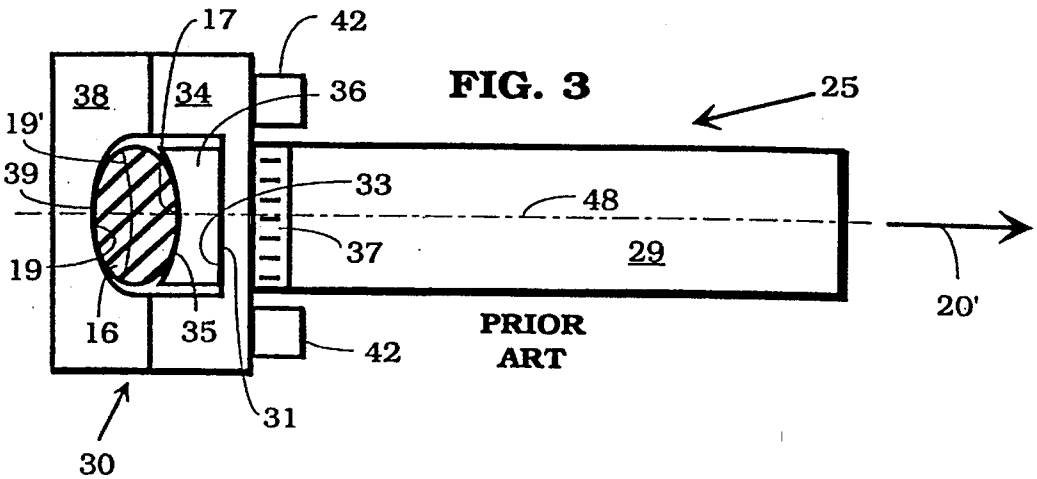
FIG. 3 PRIOR ART
FIG. 3 is a simplified top view of the prior art laser sighting assembly of FIGS. 2C–D.
Figure 7:
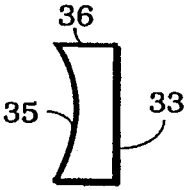
FIG. 7 PRIOR ART
FIG. 7 is a side view and FIG. 8 is an end view of a steel wedge used in the mounting clamp of FIGS. 3–5, according to the prior art.
Figure 6:
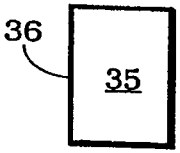
FIG. 6 PRIOR ART
FIG. 6 is a front view.
Figure 8:
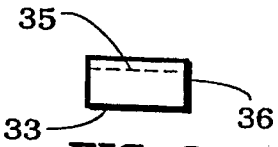
FIG. 8 PRIOR ART
Figure 5:
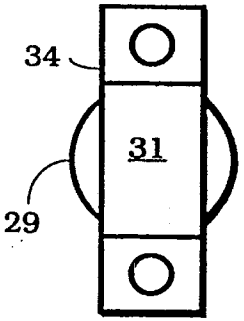
FIG. 5 PRIOR ART
FIGS. 4–5 are simplified from views of the clamping portions of the assembly of FIG. 3 showing the interior clamping surfaces.
Figure 4:
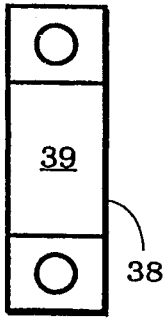
FIG. 4 PRIOR ART

FIGS. 3–9 show additional details of prior art assembly. FIG. 3 is a simplified top view of trigger guard mounting laser sight assembly 25 of FIGS. 2C–D when in place around trigger guard 16. Arrow 3 in FIGS. 2C indicates the direction of the view of FIG. 3. FIGS. 4–5 show the interior (facing) surfaces of clamp portions 34, and FIGS. 6–8 show views of steel wedge 36 which is inserted between clamp portion 34 and trigger guard 16 when clamp 30 is assembled. FIG. 6 is a front view, FIG. 7 a side view and FIG. 8 an end view of wedge 26.

Clamp portions 34, 38 squeeze directly or indirectly against trigger guard 16, thereby holding light emitting module 29 approximately in position. Removable steel wedge 36 is placed between clamp portion 34 and trigger guard 16. Wedge 36 has flat surface 33 which bears against mating flat surface 31 of clamp portion 34. Opposed to surface 33 of wedge 36 is single curved surface 35 which nominally matches outward facing curved surface 17 of trigger guard 16. As used herein the words "single curved" are intended to refer to surfaces that curve only in one direction, as for example a cylindrical surface. Removable clamp portion which nominally matches inwardly facing convex curved surface 19 of trigger guard 16. Portions 34,38 are held together by screws 42. Trigger guard 16 is clamped between portions 34, 38 and wedge 36, thereby attaching light emitting module 29 to weapon 10.

Figure 9:
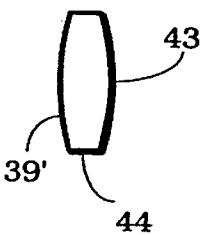
FIG. 9 PRIOR ART
FIG. 9 is a side view similar to FIG. 7 but of a further steel wedge according to the prior art.

FIG. 9 is a side view similar to FIG. 7 but of further wedge 44 intended to fit between clamp portion 38 and differently shaped inward surface 19' of trigger guard 16. Single curved surface 39' of wedge 44 mates with surface 39 of clamp portion 38 and surface 43 of wedge 44 is intended to press against inward facing concave surface 19' of trigger guard 16 (see dashed line 19' in FIG. 3), when it has such shape. Prior art clamp portions 34, 38 and wedges 36, 44 are of carbon steel, stainless steel or a combination thereof so as to not deform when clamp 30 is assembled. The wedges of the prior art are about as hard as or harder than the materials used for most gun trigger guards. As a consequence, when clamp 30 is firmly tightened, wedges 36, 44 can cut into and/or mar trigger guard 16.

It has been found that prior art mounting clamp 30 often lacks sufficient ruggedness to reliably maintain alignment of light beam 20' with bullet trajectory 18 without custom fitting. This is caused in part by the fact that trigger guard 16 often has minor protrusions or other manufacturing variations that provide high-spots on which clamp 30 can rock or shift when subjected to shock forces during weapon firing or other use. Hardened steel wedges and increased clamping force (e.g., by further tightening of screws 42) do not solve the problem. Unless the trigger guard and clamp parts are hand shaped to insure a perfect fit, the hard materials used for prior art clamp 30 exacerbate rather than ameliorate the problem of the clamp loosening or slipping during handling and use of the weapon. The firing and handling shock can displace the imperfectly mating surfaces and cause the clamp to loosen or shift, thereby producing misalignment of the aiming light beam.

A further complication is the lack of any index, key or other mechanism for fixing relative orientation angles 51, 53 of module 29 with respect to clamp 30, trigger guard 16 and weapon 10. Due to optical anomalies in many solid state light emitters, light beam 20' is often not coincident with longitudinal axis 48 of module 29. As a consequence, if module 29 is rotated about axis 48 this can change the sighting of the weapon. Relative rotation of module 29 with respect to end region 37 is necessary to change the batteries in prior art assembly 25. Relative rotation can also occur during handling and firing of the weapon. Thus, lack of any fixed reference for predetermining angles 51, 53 further contributes to the prior art arrangement having less than the desired degree of stability and repeatability.

While the prior art arrangement 25 may have been intended to be a universal mount, it has often been necessary to field modify the trigger guard and/or the mounting clamps or wedges to produce a custom fit. This is both expensive and time consuming and generally requires special skill, tools and experience that is often beyond the capacity of weapon users who are not experienced gun smiths or machinists. Custom fitting is especially difficult with the steel wedges 36, 44 used in the prior art. The above mentioned problems are overcome by the present invention which will be more readily understood by reference to FIGS. 1, 2A–B and 10–33 and the accompanying explanation.

Figure 12:
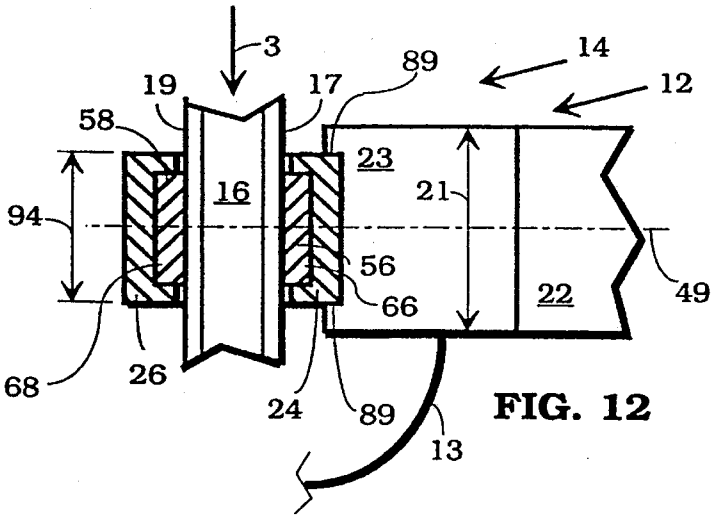
FIG. 12 is a partial cross-sectional and cutaway side view of the mounting portion of the assembly of FIGS. 10–11 according to the present invention and in a direction normal to the views of FIGS. 10–11.
Figure 10:
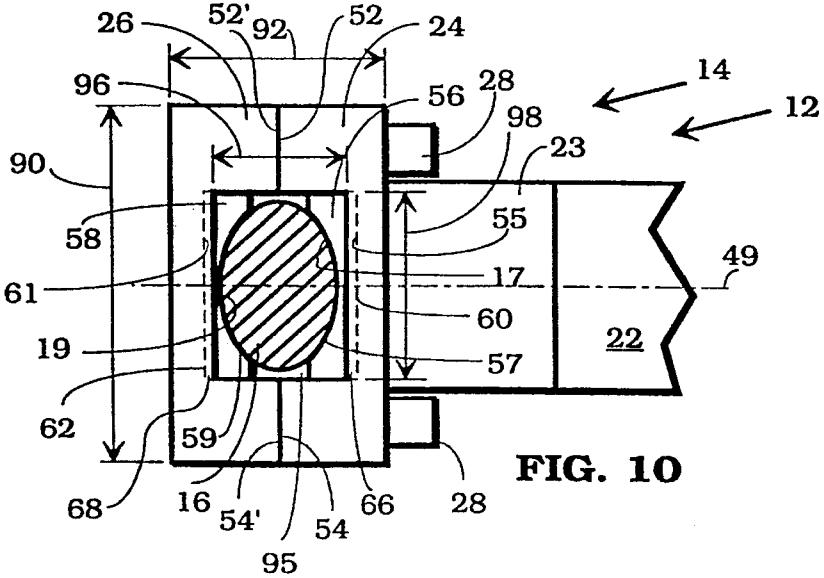
FIG. 10 is a simplified top view analogous to FIG. 3 of the mounting portion of the assembly of FIGS. 2A–B according to the present invention.
Figure 11:
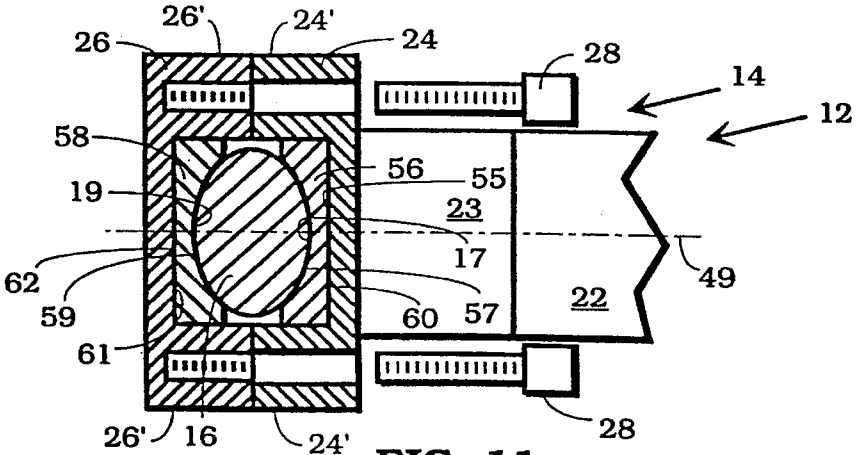
FIG. 11 is a partial cross-sectional and cutaway top view of the mounting clamp of FIGS. 10.

FIG. 10 is a simplified top view analogous to FIG. 3, but of the laser sight assembly of FIGS. 1 and 2A–B, according to the present invention. The view of FIG. 10 is in the direction of arrow 3 in FIG. 2A. FIG. 11 is a top view looking in the same direction as in FIG. 10 but providing a partial cross-sectional and cutaway view of clamp 14 at assembly center line 49 to show further details. FIG. 12 is a partial cross-sectional side view of clamp 14 along centerline 49 in a direction normal to the view of FIGS. 10–11.

Referring now to FIGS. 10–12, clamp 14 comprises separable, generally U-shaped, clamping portions 24, 26 having arms 24', 26'. Portion 24 is rigidly coupled to end portion 23 of light emitting module 22 by screw threads or other conventional mechanisms (e.g., see FIG. 33). As is explained more fully in connection with the discussion of FIGS. 31–32, a key, index or other alignment mechanism is provided between clamp portion 24 and end portion 23 so that their angular relationship around axis 49 is predetermined. Portion 24 may be integral with or removable from end portion 23 of module 22. It is important that once assembly 12 is installed on trigger guard 16 (or other support) that clamp portion 24, end portion 23 and light emitting module 22 not shift relative to each other. While clamp portions 24, 26 are conveniently joined by screws 28, this is not essential. Any mechanism for holding portions 24, 26 in the desired relationship will suffice. Alternative mechanisms for fixing portions 24, 26 include bolts, rivets and cam-locks. Other mechanisms well known in the art can also be used. Clamp portions 24, 26 are conveniently made from aluminum, but other materials of equivalent or greater strength can also be used for clamp portions 24, 26.

Located between clamp portions 24, 26 and trigger guard 16 are inserts 56, 58, respectively. In the preferred embodiment, inserts 56, 58 are removably retained within recesses 66, 68 of clamp portions 24, 26, respectively. The design and function of inserts 56, 58 in relation to clamp portions 24, 26 will be more fully understood by reference to FIGS. 13–30.

FIGS. 13–14 are side views of clamp portions 24, 26 when disassembled and FIGS. 15–16 are front views of clamp portions 24, 26 showing, respectively, interior surfaces 60, 62 of recesses 66, 68 of clamp portions 24, 26. When mounting clamp 14 is assembled, surfaces 60, 62 face toward each other and toward surfaces 17, 19, respectively of trigger guard 16.

FIG. 17 is a front view, FIG. 18 is a side cross-sectional view and FIG. 19 is an end cross-sectional view of either or both of inserts 56, 58, according to a first embodiment. Inserts 56, 58 have curved surfaces 57, 59 which, when assembled in clamp 14, face toward each other and toward curved surfaces 17, 19 of trigger guard 16, respectively. Inserts 56, 58 have substantially planar surfaces 55, 61 spaced apart from and opposed to curved surfaces 57, 59, which mate with substantially planar surfaces 60, 62 in recesses 66, 68 of clamp portions 24, 26, respectively. Length 70 of inserts 56, 58 and lengths 74, 74' of recesses 66, 68 (see FIGS. 15–17), and similarly with width 72 and widths 76, 76', differ by small clearance amounts so that inserts 56, 58 fit snugly but removably in recesses 66, 68. The lateral dimensions 72, 72', 74, 74', and preferably also depths 78, 78' of recesses 66, 68, respectively, are desirably the same. In this way, any insert 56, 58 can be installed in either of recesses 66, 68, but this is not essential.

It will be noted that recesses 66, 68 provide two-dimensional constraint on movement of inserts 56, 58, i.e., inserts 56, 58 cannot slide within clamp portions 24, 26 in directions normal to assembly centerline 49. This is a significant improvement over the prior art wherein no such recesses are provided and wedges 36, 44 have at least one degree of freedom of motion within clamp portions 34, 38 perpendicular to centerline 48, that is, in a direction normal to the plane of the drawing in FIG. 3. Recesses 66, 68 account in part for the superior reliability and ruggedness of assembly 12 of the present invention, and are preferred but not essential. Other mechanisms for retaining inserts 56, 58 can also be used.

Inserts 56,58 (see FIG. 19) have overall thickness 71, central depression depth 73 and minimum thickness 75. Overall thickness 71 is chosen in relation to the magnitude of central depression depth 73 so as to match the curvature of trigger guard 16 such that remaining material thickness 75 exceeds depth 78, 78'of recesses 66, 68 by about 10–50 percent or more. In this manner, the sides of recesses 66, 68 do not bear upon trigger guard 16 when mounting clamp 14 is assembled on trigger guard 16.

Figure 30:
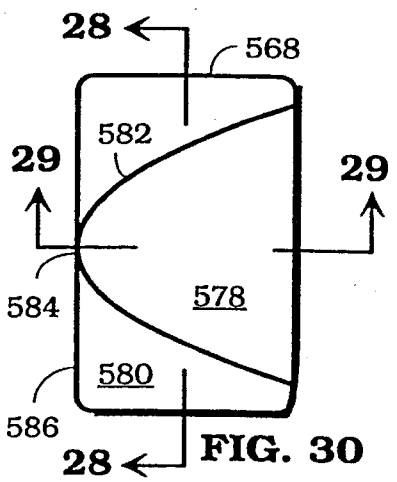
FIG. 30 is a front view analogous to FIG. 17 but according to a still further alternate form of the insert of FIG. 17.

As has been previously noted, trigger guards vary greatly in shape and curvature. Therefor a simple, single-curved shape for inserts 56, may not be suitable for all weapons. Accordingly, various insert shapes are desirable. FIGS. 20–30 illustrate exemplary alternative shapes for inserts 56, 58. For convenience of explanation, only reference numbers relevant to insert 56 are indicated on FIGS. 20–30, but those of skill in the art will understand based on the description herein that FIGS. 10–30 apply to both of inserts 56, 58, even though the reference numbers applicable to insert 58 are not included in all figures. Even numbered FIGS. 20, 22, 24, 26, 28 are cross-sectional views analogous to FIG. 18 and odd numbered FIGS. 21, 23, 25, 27, 29 are cross-sectional views analogous to FIG. 19. FIG. 30 is a front view analogous to FIG. 17. Reference number 560–568 and 570–578 are used, respectively, in FIGS. 20–30 to identify the alternate forms of insert 56 and trigger guard mating surface 57.

FIGS. 17–19 illustrate insert 56 having single curved concave surface 57 extending a distance 80 less than length 70. With appropriate modification of distance 80, the front view of FIG. 17 applies to FIGS. 20–27 and separate front views for FIGS. 20–27 have been omitted for simplicity.

Figure 21:
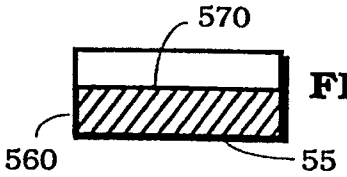
Figure 20:
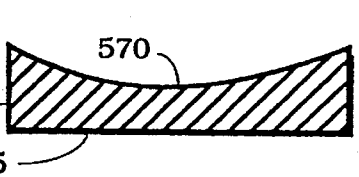
Figure 23:
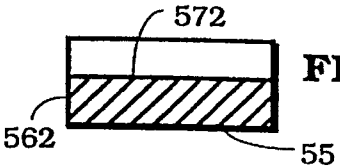
Figure 22:
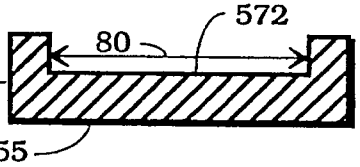
Figure 25:
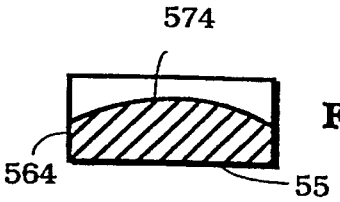
Figure 24:
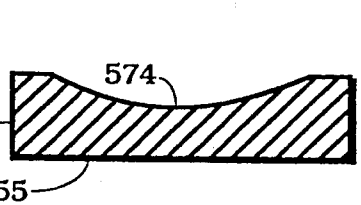

FIGS. 20–21 show alternative insert 560 having single curved concave surface 570 in which distance substantially equals length 70. FIGS. 22–23 show alternate insert 562 in which surface 572 is substantially planar and distance 80 is less than length 70. Those of skill in the art will understand based on the description herein that inserts having various distances 80 relative to length 70 are desirably provided to fit different trigger guards. FIGS. 24–25 show alternative insert 564 in which surface 574 is doubly curved, being concave in the direction parallel to length 70 and convex in the direction parallel to width 72 of FIG. 17, or vice-versa (not shown).

Figure 28:
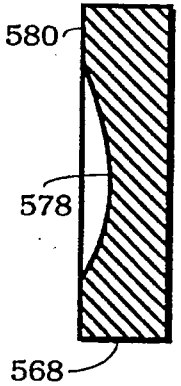
FIGS. 20, 22, 24, 26, 28 are cross-sectional views analogous to FIG. 18 and FIGS, 21, 23, 25, 27, 29 are cross-sectional views analogous to FIG. 19, of alternatives forms of the insert of FIG. 17.
Figure 29:
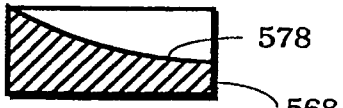
Figure 27:
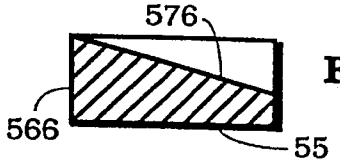
Figure 26:
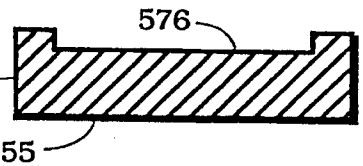

FIGS. 26–27 show alternative insert 566 in which surface 576 is substantially planar but tilted at an angle so that a depression having a triangular shaped cross-section is provided. FIGS. 28–30 illustrate alternative insert 568 in which surface 578 is doubly curved so as to be concave in orthogonal directions corresponding to the cross-sections of FIGS. 28–29. While alternative insert 568 is shown as having surface 578 intersect upper surface 580 of insert 568 along substantially curved line 582 whose apex 584 meets edge 586 of insert 568, this is not essential. Intersection 582 may have any shape and location on insert 568 depending upon the curvature needed in surface 578 to reasonably match the contour of trigger guard 16 of specific weapons or other attachment location. While insert 568 is illustrated as having surface 578 be double curved, those of skill in the art will understand based on the description herein that surface 578 can alternatively be singly curved, for example, curved in the cross-section of FIG. 28 but plane in the cross-section of FIG. 29, or vice versa.

It has been found that proper selection of the material for inserts 56, 58 provides very stable and rugged laser sight mounts. Not all materials are suitable. Those materials that are too easily deformed (e.g., soft rubbers and vinyls) provide insufficient rigidity in the mount and are not suitable. When the clamp is tightened they extrude from between the clamp and the trigger guard and an adequate clamping force cannot be maintained. Conversely, those materials that are too hard (e.g., steels and other hard metals) fail to adequately accommodate irregularities in the trigger guard surfaces, thereby leading to mounts that irregularly cut into the trigger guards and/or rock on high spots. Thus, materials of intermediate hardness and compressibility are more effective because they combine the ability to deform around minor irregularities in the trigger guard surfaces (thereby providing a large contact area) while at the same time not extruding unduly (thereby allowing an adequate clamping force to be maintained). As used herein the word, "elastomeric" is intended to refer to such materials of intermediate hardness and compressibility.

Convenient elastomeric materials are polymers that can be molded into the desired shapes by inexpensive processes. Relatively harder polymers such as Nylon, polycarbonate, ABS and PVC are generally suitable, especially when combined with glass or ceramic fillers or both. Relatively softer materials such as rubbers and soft vinyls are generally not as useful. Fillers of ceramic or glass powder or mixtures thereof in the range of 5–20 percent by weight are useful with about 7–15 percent being convenient. Glass filled Nylon having about 10 percent by weight of glass powder is a preferred material for inserts 56, 58. Molded inserts of such material are available from Industrial Technologies, Inc. of Phoenix, Ariz. It is desirable that the insert material have what is referred to in the art as "memory" that is, that it can be made to assume an arbitrary shape which it then remembers and will return to, even though there may be some intervening mechanical deformation, but this is not essential.

By way of example, for module 22 of diameter 21 (see FIG. 2A) of about 0.55 inches, dimension 90 (see FIG. 10) of clamp 14 is about 0.79 inches, dimension 92 (see FIG. 10) is about 0.625 inches and dimension 94 (see FIG. 12) is about 0.375 inches. With clamp 14 assembled so that surfaces 52, 52' and 54, 54' of portions 24, 26 are in contact, opening 95 (see FIG. 10) through which passes trigger guard 16 has dimension 96 of about 0.20 inches (divided about equally between portions 24, 26) and dimension 98 of about 0.625 inches. Depths 78, 78' (see FIGS. 13, 14) of recesses 66, 68 are conveniently about 0.05 inches but larger or smaller depths can also be used, depending upon the trigger guard size. It is desirable that the U-shaped clamp portions 24, 26 have approximately equal length arms 24', 26' so that mating surfaces 52, 52' and 54, 54' are approximately at the center of distance 96 (see FIG. 10), but this is not essential. With use of inserts 56, 58 of varying thickness, the above-described opening is sufficient to accommodate a trigger guard up to about the 0.2×0.625 inches opening size. Larger clamps 24 26 can be provided to accommodate trigger guards or other mounting members having larger dimensions. The depths and shapes of surfaces 57, 59 (see FIGS. 17–19) are chosen to approximately match the curvature of the trigger guard or other mounting member.

It is desirable that inserts 56, 58 be subject to a significant compressive force as clamp 14 is closed by screws 28. This is so that inserts 56, 58 compress around any irregularities in trigger guard 16 and make a broad area contact to trigger guard 16. When screws 28 are tightened, it is desirable that inserts 56, 58 are compressed in the direction of axis 49 by about 1–15%, more conveniently about 2–12% and preferably about 3–6%, but larger or smaller compression may also be used, depending upon the irregularities in particular trigger guards and the materials chose for inserts 56, 58. It is desirable that a large surface area contact be made to trigger guard 16 by inserts 56, 58 without significant lateral (perpendicular to axis 49) extrusion of the insert material. The problem created by high spots on trigger guard 16 in conjunction with hard steel wedges 35, 44 of the prior art is avoided by use of the above-described elastomeric inserts retained in depressions 66, 68. Depressions 66, 68 act to prevent undue lateral plastic flow of the elastomeric materials in addition to restricting their motion within clamp portions 24, 26.

In a preferred embodiment, inserts 56, 58 have lateral dimensions smaller than recesses 66, 68, e.g., (see FIG. 17) with dimension 72 of about 0.31 inches and dimension 70 of about 0.62 inches. A clearance amount of about 1–5 mils is convenient with about 1–2.5 mils being preferred between inserts 56, 58 and the walls of recesses 66, 68. Larger amounts can also be used provided that significant motion of the inserts within the recesses is avoided. Smaller amounts of clearance makes it difficult to install and remove the inserts. In the preferred embodiment, the inserts can be inserted and removed by hand. Typical inserts 56, 58 (see FIG. 19) had overall thickness 71 of about 0.15 inches and minimum thickness 75 of about 0.075–0.125 inches. Surfaces 570, 574 and 578 had radii of curvature of typically about 0.5 inch, but larger or smaller values can be used according to the shapes of trigger guard 16 being accommodated.

It has been found that a small amount of cyanoacrylate resin (e.g., Superglue™) introduced between metal trigger guard 16 and Nylon inserts 56, 58 improves the stability of the laser sight mounting. This is counter-intuitive since it is known that such material does not adhere to Nylon and therefore cannot be expected to have any glue-like action with respect to Nylon inserts 56, 58. However, it does adhere to the surface of metal trigger guard 16, and is believed to be useful in providing a higher friction surface thereon. Because the cyanoacrylate resin does not stick to the Nylon inserts, they can be easily removed from the weapon without damage when the laser sight is de-mounted. Conversely, the cyanoacrylate resin does react with ABS or PVC inserts and will stick them firmly to the trigger guard so that they must often be destroyed in order to remove them and/or the mount. Generally, they must be destroyed in order to remove them. Where the laser sight is intended to be only temporarily mounted on a particular weapon, this is not advantageous. Accordingly, the Nylon inserts are preferred.

Figure 31:
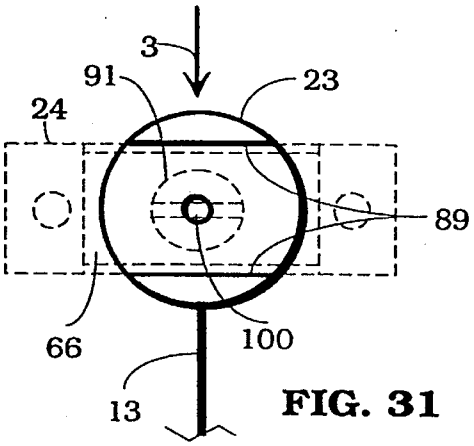
FIG. 31 is an end view of the portion of the light emitting assembly to which the trigger guard mounting clamp attaches, according to the present invention.
Figure 34:
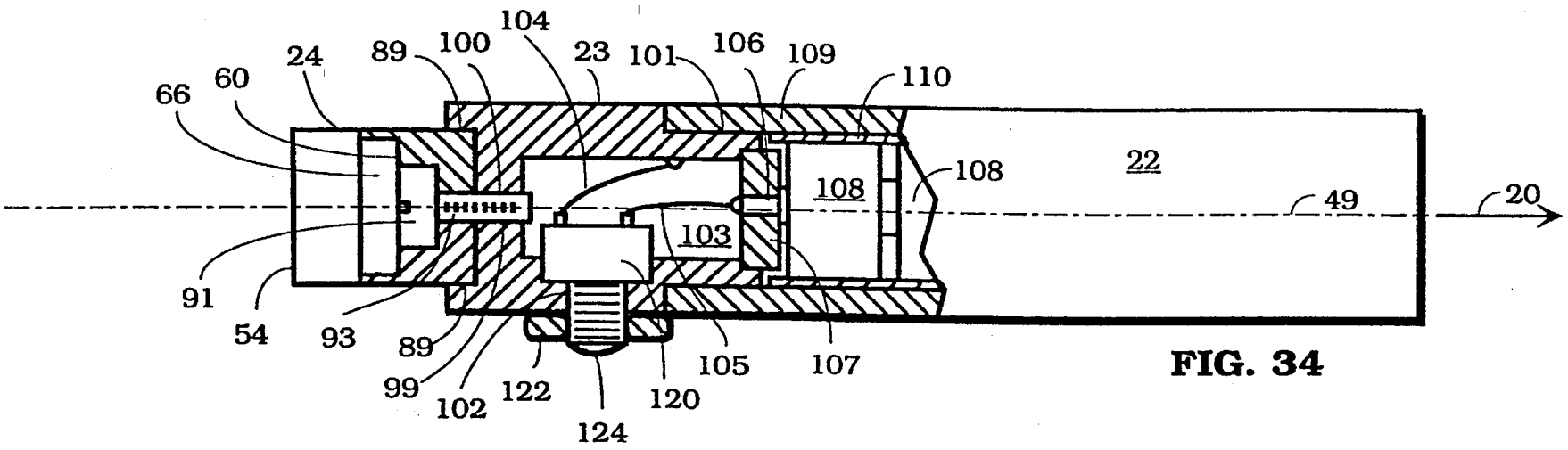
FIG. 34 is a partial cross-sectional and cutaway side view, similar to the view of FIG. 33, but according to a further embodiment of the present invention.

As noted earlier, a feature of the present invention is that clamp portion 24 couples to end region 23 in a predetermined position set by reference surfaces or other keys or indexes. FIG. 31 is an end view of module end portion 23 where clamp portion 24 attaches. Clamp portion 24 is shown in phantom on FIG. 31. Additional details are shown in FIGS. 33–34. Threaded shaft 93 of attachment screw 91 (see FIG. 33) passes through hole 99 in clamp portion 24 and engages threaded hole 100 in end portion 23, thereby attached clamp portion 24 firmly to end portion 23. Raised lips 89 (see FIGS. 12, 31 and 33) in combination with attachment screw 91 reproducibly locate clamp portion 24 with respect to end portion 23 of module 22 and prevent relative translation or rotation thereof. This is unlike the prior art arrangement illustrated in FIGS. 2C–5 wherein it can be seen that prior art module 29 and end region 37 can rotate with respect to clamp portion 34 and wedge 36 can move laterally with respect to clamp portion 34, and therefore module 29 can move and/or rotate or both with respect to trigger guard 16.

Figure 32:
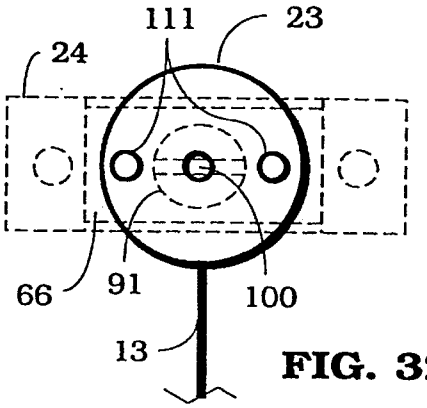
FIG. 32 is an end view analogous to FIG. 31 but according to a further embodiment of the present invention.

FIG. 32 is similar to FIG. 31 but illustrating a further embodiment of the present invention in which the relative location and orientation of end portion 23 and clamp portion 24 is determined by pins 111. Such an arrangement prevents rotation and/or lateral displacement of end portion 23 and clamp portion 24, thereby insuring that light emitting module 22 is in a reproducible relationship to trigger guard 16. Based on the description herein, persons of skill in the art will understand that any other index or interlocking surface features or other reference mechanism well known in the art may be employed for the same purpose.

FIG. 33 is an exploded, partial cross-sectional and cutaway side view of trigger guard mounting light emitting assembly 12 of the present invention, showing additional details. Clamp portion 24 and end portion 23 and part of light emitting module 22 are shown in cross-section. End portion 23 and module 22 are conveniently joined by threads on mating surfaces 101, wherein the thread details are omitted for simplicity. Cord 13 passes through opening 102 in a side-wall of portion 23 into interior space 103. Cord 103 conveniently contains two electrical wires 104, 105 which are insulated from each other but which make contact to other conducting regions within space 103. Wire 104 is desirably attached (e.g., by soldering, welding or clamping) to an interior surface of portion 23 in space 103. Wire 105 is attached by the same or other methods to electrical contact stud 106 in insulated member 107. The other end of stud 106 is in electrical contact with one pole of battery 108. Multiple batteries 108 can be serially arranged within module 22. The outer casings of batteries 108 are separated from housing 109 of module 22 by cylindrical insulating sheath 110.

Electrical wires 104, 105 extend in cord 13 to switch 15 (see FIG. 1). End portion 23 and housing 109 of module 22 are desirably of metal or other electrically conducting material. When switch 15 is closed, electrical continuity is provided from one pole of batteries 108 through wires 104,105 back to end region 23 and housing 109 of module 22, thereby completing the electrical circuit to power-on module 22 so that light beam 20 is emitted. A feature of the present invention is that cord 13 has a fixed orientation with respect to clamp portion 24 and therefore with respect to trigger guard 16. This is accomplished by making connections 104, 105, 13 to switch 15 via end portion 23 whose relationship to clamp 14 is predetermined by index or alignment mechanism, 111.

FIG. 34 is a partial cross-sectional side view, similar to the view of FIG. 33, but according to a further embodiment of the present invention, and with the elements 22, 23, 24 and 91 assembled. Like reference numbers are used to indicate the same or equivalent items. The embodiment of FIG. 34 differs from that in FIG. 33 in that cord 13 leading to switch 15 is omitted and switch 120 is mounted directly in end portion 23. Wires 104, 105 within cavity 103 connect to the poles of switch 120. Switch 120 is held in end portion 23 by any convenient mechanism, as for example, but not limited to, nut or C-collar 122.

Switch 120 is conveniently activated by push-button 124, wherein depressing button 124 once causes switch 120 to turn on (or off) and depressing button 124 a second time causes switch 120 to turn off (or on). While the use of such a push button switch is convenient, other types of switches well known in the art may also be used. Non-limiting examples are a rotary switch and a toggle switch. As depicted in FIG. 34, button 124 faces downward with respect to end portion 23, clamp portion 24 and trigger guard 16, that is, in the same direction as cord 13 in FIGS. 1 and 33. This is the preferred arrangement. However, button 124 may protrude from the sides of end portion 23 that face in a direction to the left or right of the trigger guard or may protrude upward, but this is usually less desirable. As with the arrangement of FIG. 33, the above-described relationship between clamp portion 24 and end portion 23 insures that the orientation of switch button (or other actuator) 124 is predetermined and is not affected by separating end portion 23 from module 22 in order, for example, to change batteries 108. With the arrangement of either FIGS. 33 or 34, module 22 may be activated without disturbing the orientation of module 22 relative to clamp 14 and trigger guard 16.

Figure 35:
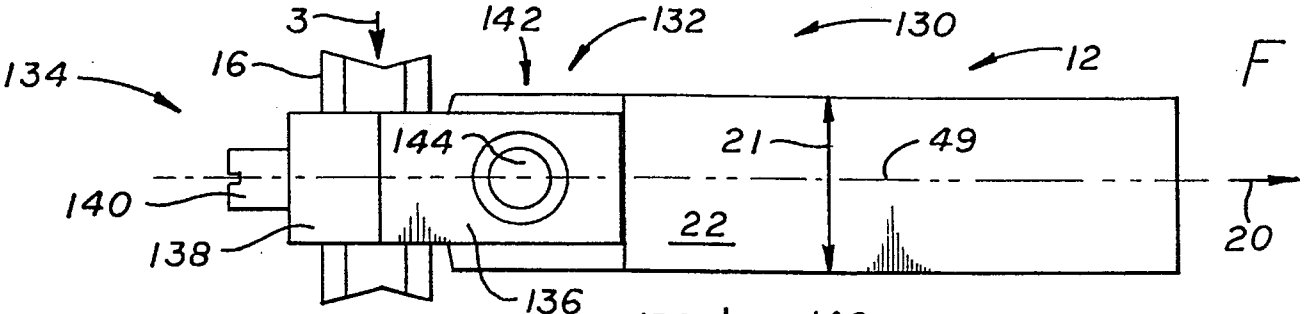
FIG. 35 is a simplified side view analogous to FIG. 2A, of a laser mount and integral switch assembly, according to a further embodiment of the present invention.
Figure 36:
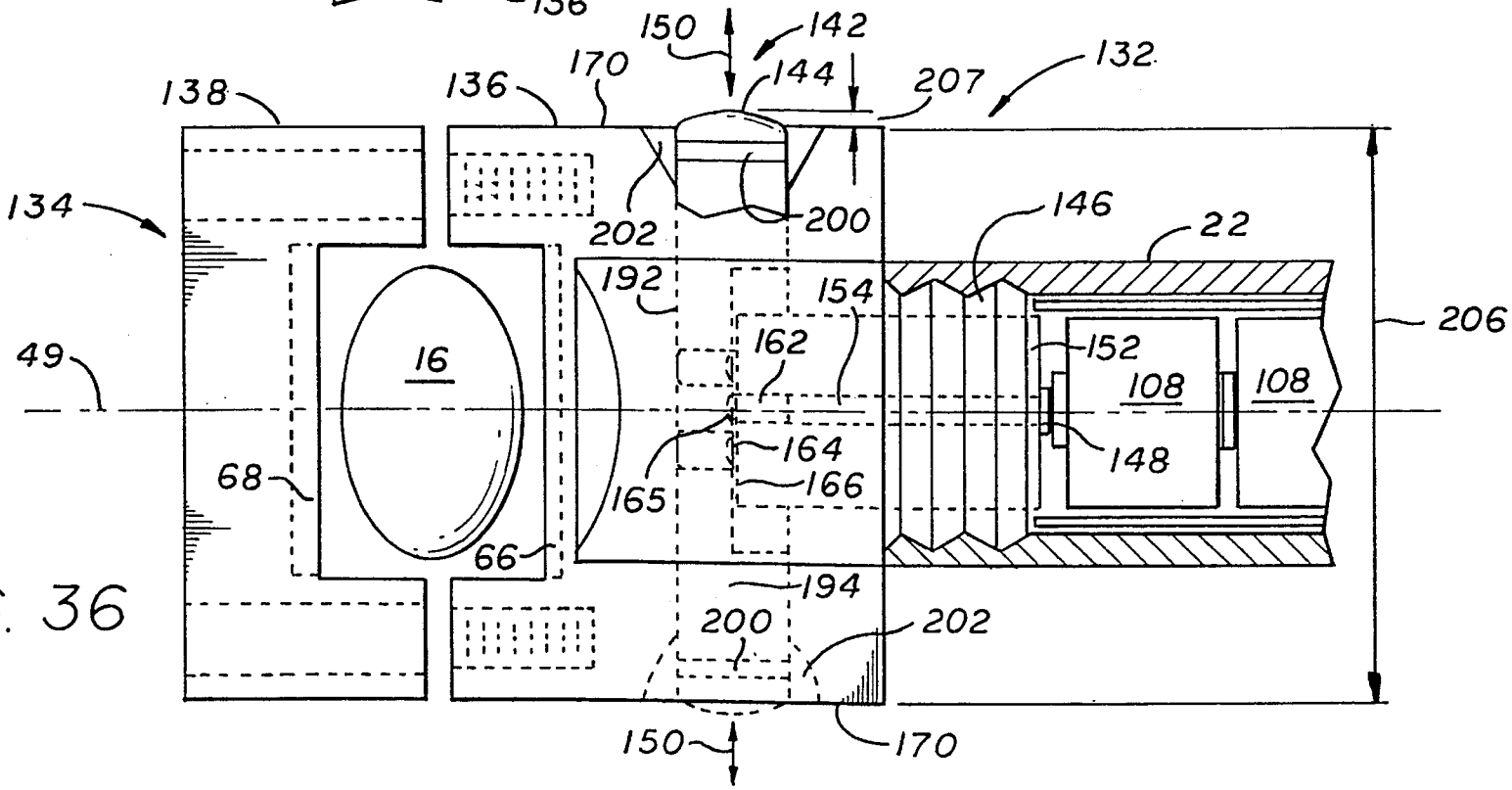
FIG. 36 is a simplified top view analogous to the view shown in FIG. 10 of the assembly of FIG. 35, showing greater detail.

FIG. 35 is a simplified side view analogous to FIG. 2A, of laser sight and integral switch assembly 130, according to a further embodiment of the present invention. FIG. 36 is a simplified top view of end portion 132 of assembly 130 of FIG. 35 (looking in the direction of arrow 3 in FIG. 35), showing clamp 134 and switch 142 in greater detail.

Other forms of integral switch may also be advantageously employed. For example, in accordance with another aspect of the present invention, one such integral switch facilitates actuation from either side of weapon 10, and provides tactile feedback to the user. Referring to FIGS. 35–39, a laser sight and switch assembly 130 includes a light emitting module 22, an end portion 132, a clamp 134 and an integral slide switch 142. Light emitting module 22 is of a predetermined diameter 21, and emits light beam 20, generally along centerline 49. End portion 132 is attached to trigger guard 16 by clamp 134 in generally the same manner as has been previously discussed in connection with clamp 14. End portion 132 suitably includes a threaded region 146 which threadedly attaches to light emitting module 22 so that electrode 148 makes contact with battery 108 in generally the same manner as electrode 106 of FIGS. 33, 34.

Clamp 134 has mating portions 136, 138 (shown slightly separated in FIG. 36) analogous to portions 24, 26 previously described which clamp to trigger guard 16. Clamp portions 136, 138 are conveniently held together by machine screws 140, but any convenient mechanism for joining clamp portions 136, 138 may also be used, as has previously been described. Clamp portions 136, 138 contain recesses 66, 68 which receive inserts 56, 58 as previously described (see FIG. 10). Clamp portion 136 is suitably formed of an electrically conductive material, such as metal (e.g., brass, steel, aluminum, or titanium). Clamp portion 138 is also preferable of a similar material but this is not essential. Clamp portion 136 differs from clamp portion 24 of, for example, FIG. 2A, in that it contains slide switch 142. Clamp portion 136 suitably includes: peripheral arms 136A (analogous to arms 24'); a body 136B including a transverse channel (hole) 194 extending therethrough; and an axially aligned post portion 136C. Post portion 136C is adapted to engage light emitting member 22, e.g. by exterior threads, and includes an axial bore 195 communicating with channel 194.

Figure 36A:
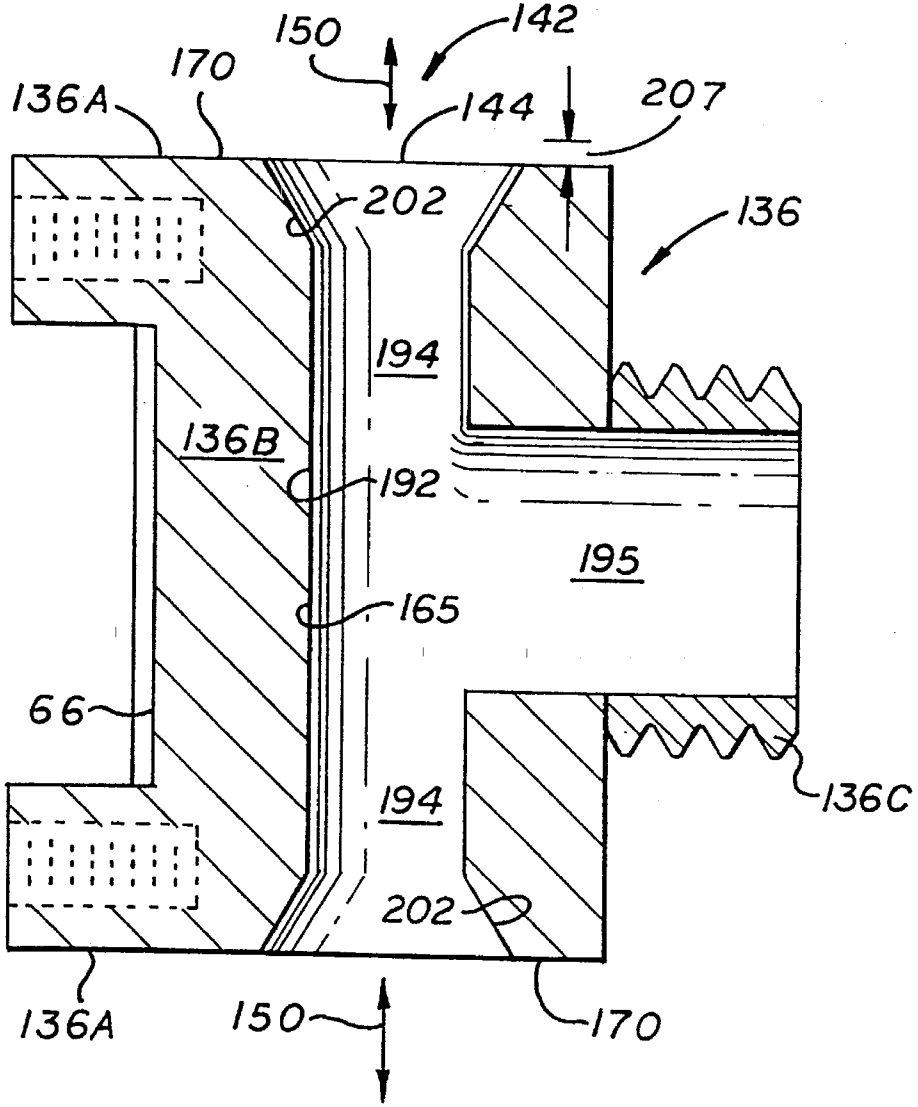
Figure 39:
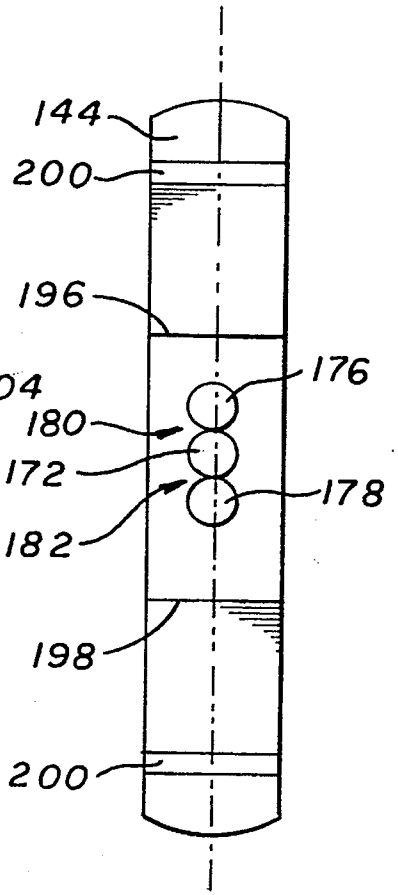
Figure 38:
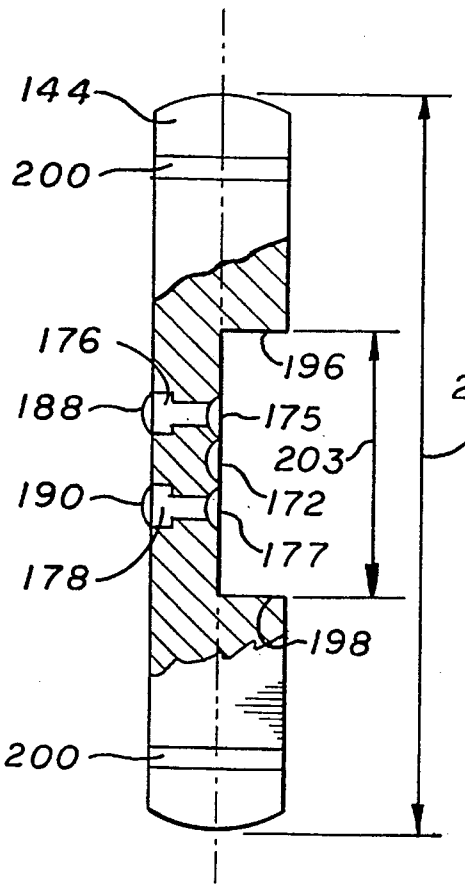
FIG. 38 is a front view of a slide switch actuation member of the assembly of FIG. 35.
Figure 37:
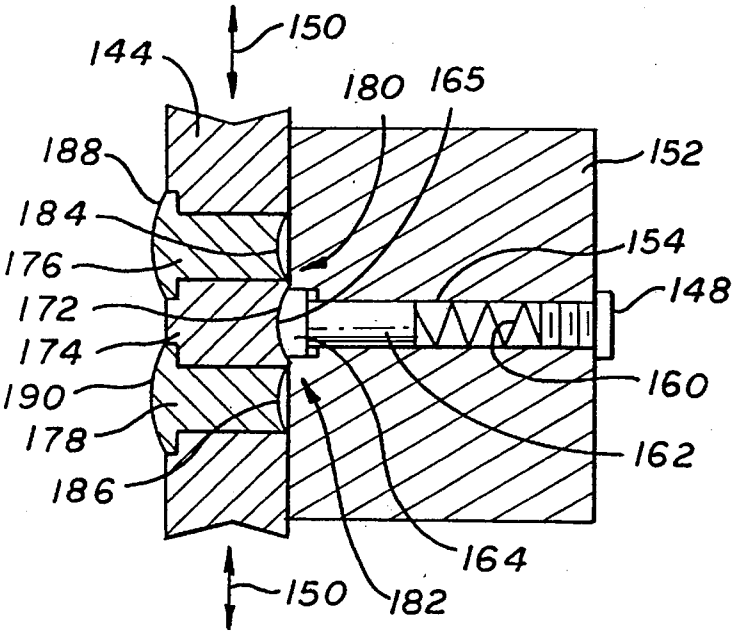
FIG. 37 is a partial cross-section and cut-away view of part of the interior of the assembly of FIG. 35, showing further details.

As best seen in FIGS. 36, 36A and 37, switch 142 suitably comprises a sliding member 144 and a block 152, both formed of insulating material. Sliding member 144 is disposed for transverse (lateral) movement within (and through) channel (hole) 194 (FIG. 36) in clamp portion 136. As best seen in FIGS. 36A, 37 and 38, sliding member 144 is suitably generally cylindrical with rounded ends, and includes: a central recess 193; a predetermined number, e.g. three, of recesses (detents) 172, 175, and 177; and respective conductive members 176 and 178. Central recess 193 is suitably of a predetermined length 203 defined by opposing shoulders 196, 198. Detents 172, 175, and 177 are of predetermined radius, and suitably centrally disposed in the bottom surface of recess 193, separated by respective intervening ridges 180 and 182. Conductive members 176 and 178 suitably include depressions 184 and 186, respectively, disposed in and suitably of approximately the same radius as, detents 172, 175 and 177. Conductive members 176 and 178 extend through member 144 and terminate in respective contacts 188 and 190, exposed, e.g. protruding from the underside of member 144. Contacts 188 and 190 are suitably rounded and effect a sliding (wiping) electrical contact with surface 192 of channel (bore) 194 as member 144 travels within clamp portion 136. As shown by arrows 150, sliding member 144 moves in a direction that is at right angles to axis 49 (and light beam 20) and to trigger guard 16. When gun 10 is held in a normal, dead-ahead firing position, direction arrows 150 are generally parallel to the ground and perpendicular to the direction of the weapon bore sight. Insulative block 152 is generally-cylindrical in shape and received within axial bore 195 of post 136C. Block 152 is suitably fixed in bore 195. This may be effected by any suitable mechanism, such as, e.g., external threads (not shown) cooperating with interior threads in bore 195. In assembly, one end of block 152 communicates with, and preferably extends into the interior battery chamber of module 22, and preferably into the interior of cylindrical insulating sheath 110, to abut battery 108. Insulative block 152 thus effectively prevents battery 108 from making electrical contact with post 136C of clamp portion 136. The other (bottom) end 166 of block 152 extends interiorly of post 136C into channel 194, and particularly into recess 193 of sliding member 144. Bottom surface 166 of block 152 is desirably in close proximity to sliding member 144, without inhibiting the ability of sliding member 144 to move back and forth in the lateral direction shown by arrows 150.

Block 152 includes an interior axial bore 154, preferably located about along center line 49, in which is located spring 160 pushing against movable piston electrode 162 and on electrode 148. Electrode 148 is suitably fixed, e.g., by threading, in insulating block 152, with electrode 148 facing toward battery 108 within light emitting module 22. Spring 160 is conveniently retained in place by electrode 148. Electrode 148, spring 160 and piston electrode 162 are conveniently formed of good electrical conductors and are biased, e.g., by the action of spring 160 into good electrical connection. Piston electrode 162 suitably includes a head 164 with a curved outer surface 165 of predetermined radius facing toward sliding member 144. Head 164 and curved surface 165 desirably protrude slightly from bottom surface 166 of insulating block 152, to engage corresponding curved recesses on sliding member 144.

The relative radii of detents 175, 177 (and depressions 184, 186 in conductive members 176, 178) and piston head surface 165 are suitably chosen such that when travel of member 144 brings detent 175 or 177 into partial registry with head 164, the bias provided by spring 160 causes head 164 to slide down the side of depression 184 or 186, effecting a desirable wiping electrical contact, and ultimately to seat in depression 184 or 186. Additionally, when a lateral force is applied to sliding member 144 while head 164 is seated in one of detents 172, 175, or 177, the interaction of the curved surfaces of the detent and head 164 will create a "vertical" component of force, causing head 164 to retract against the bias of spring 160, so that it may clear the detent and ridges 180 and 182, and lateral movement of member 144 is facilitated.

The permitted extent of lateral travel of sliding member 144 is determined by the difference between the diameter of block 152 and length 203 of recess 193; the diameter of block 152 is smaller than length 203 of recess 193 by a predetermined amount in accordance with the desired permitted extent of lateral travel.

Sliding member 144 is prevented from falling out of clamp portion 136 by the cooperation of block 152 with recess 193. At the extreme travel of sliding member 144 shoulders 196, 198 engage the interior portion of insulating block 152 so that sliding member 144 cannot be removed from clamp portion 136 without first removing block 152.

Sliding member 144 can be moved in either direction to selectively activate module 22. When sliding member 144 is centered between sides 170 of portion 136, curved surface 165 of head 164 of piston 162 preferably rests in depression 172 in sliding member 144. This retains sliding member 144 in a centered position. Region 174 of sliding member 144, immediately beneath depression 172, is insulating; when sliding member 144 is centered there is no electrical continuity and the LED within light emitting assembly is "off". This is the preferred arrangement, but not essential.

When sliding member 144 is moved in either direction indicated by arrows 150, it shifts relative to block 152 so that surface 165 of head 164 ultimately comes into registry with one or the other of depressions 175 or 177. At such point, spring 160 biases surface 165 of head 164 into electrical contact with conductive member 176 or 178 as described above.

Recesses 175 and 177 (and hence conductive members 176 and 178) are preferably disposed at positions in recess 193 such that, at the extremes of travel, one or the other of detents 175 and 177 is disposed with rounded head 164 of piston contact 162 slightly beyond center; the bias provided by spring 160 causes head 164 slide down the side of depression 175 or 177 (and depressions 184 or 186 in conductive members 176 or 178), and ultimately seating in depression 184 or 186. With head 164 in contact with either conductive member 176 or 178, a current path to activate module 22 is completed; current flows from batteries 108 through electrode 148, spring 160, piston electrode 162 and, conductive member 176 or 178, to clamp portion 136 and back to the housing of light emitting module 22 to an LED in the interior of module 22 as described above. Once head 164 slips into depressions 175 and 177, head 164 is seated and will remain in position unless sliding member 144 is pushed back toward the center. Thus, the combination of sliding member 144, spring 160, piston 162 with curved head 164 and depressions 172, 175, 177 give switch 142 a desirable snap-type action, e.g., it clicks-on or clicks-off when moved off-center or on-center.

Sliding member 144, has therein near its external ends, red or other distinctively colored bands 200. When sliding member 144 is moved so as to allow head 164 to contact member 176 or 178, then one or the other of colored bands 200 is visible to the user. This alerts the user to the fact that the switch 142 has been placed on the "on" position.

Another feature of the present invention is funnel or bowl shaped depressions 202 in clamp portion 136. This helps the user to automatically center his or her finger on the end of sliding member 144 by touch alone, even though sliding member 144 does not protrude significantly beyond sides 170 of clamp portion 136. Depressions 202 also make it easy to move sliding member 144 to its off-center position to turn light emitting module 22 "on". This means that length 204 of sliding member 144 may be made approximately equal to width 206 of clamp portion 136. Thus, there is little if any need for member 144 to protrude significantly from clamp portion 136. It has been found that sliding member 144 can be flush or protrude only slightly beyond sides 170 of clamp portion 136 when in the centered position. The minimal protrusion coupled with the rounded end shape of sliding member 144 is a very useful since this minimizes any possibility of snagging switch 142 of the user's holster or clothing and accidentally turning light emitting module 22 "on" or "off" when gun 10 is withdrawn from or inserted in a holster or the user's belt or pocket.

Block 152 and sliding member 144 can be made of any convenient insulating material such as, for example, plastic, but machinable Nylon™ is preferred. In an apparatus suitable for use with a 0.5 inch diameter laser module 1.0 inch wide clamp portion 136, sliding member 144 is suitably of a predetermined length 204 of about 1.050 inches, and predetermined diameter, e.s. is conveniently about 0.182 inches, and, when centered, protrudes less than about 0.050 inches, preferably about 0.025 inches, beyond sides 170 of clamp portion 136. Lateral travel of sliding member 144 is about 0.065 inches either side of its center position. Indicator bands 200 are suitably located about 0.050 inches from the ends of sliding member 144 and are about 0.050 inches wide. The ends of sliding member 144 have a radius of curvature of about 0.156 inches. Brass, steel, aluminum, titanium or combinations thereof are suitable metals for clamp portions 136, 138, 146 and electrodes or contact members 148, 162, 164, 176, 178 and spring 160. The dimensions of the various pans will depend upon the size of the light emitting module to which it attaches and the trigger guard to which the assembly is intended to be mounted. Persons of skill in the art will understand how to make such selections based on the teachings herein.

It is apparent based on the above description that the present invention provides a single clamp laser sight beam assembly with a light emitting module mounting mechanism of improved performance and a slide switch of great convenience and efficacy. The problem created by rocking of the steel wedges of the prior art on high points on the trigger guard is avoided. The problems with the higher cost of the prior art of steel wedges and the difficulty encountered in making them to match many guns or modifying them to fit are also avoided. The prior an problem of failing to provide a fixed predetermined relationship and orientation between the clamp and the laser module is also avoided. As a result, the shock resistance of the invented single clamp mounting system is much improved over prior an single clamp universal mounting arrangements, and fewer corrective adjustments are needed to maintain alignment of the laser beam with the weapon boresight. Further, the invented trigger guard mounting laser sight can be installed by an ordinary gun user with little if any custom fitting and without aid of a gunsmith or skilled machinist. These are significant advantages that make the present invention a practical and comparatively inexpensive laser sight assembly suitable for do-it-yourself users.

Further, for the same cost, the present invention can provide a much larger selection of molded inserts so that ordinary users can adapt the laser sight to a broader variety of weapons, i.e., so that it is more universal with little or no custom fitting. Those inserts that are not needed for a particular installation can be discarded or saved for future use, with little wasted value. These are also desirable features.

A still further advantage of the invented configuration is that by having the electrical switch exit located in the end portion of the module which forms part of the trigger guard clamp rather than having it exit from the light emitting module itself, the end portion and the switch may be left in place on the weapon when the light emitting module is removed to change its internal batteries. This is a great convenience since it need not be removed from the gun in order to change the internal laser module batteries. Thus, the invented arrangement is not only easier to use but also is less likely to create misalignment of the sighting light beam as a result of changing the batteries A further advantage of the slide switch described herein is that it is fitted into the clamp portion of the module in such a way and has a shape such that there is little or no protrusion which could interfere with drawing or replacing the weapon in its holster or cause it to snag on the holster or clothing of the user. Further the design and construction of the slide switch is such that it may be easily manipulated in an equivalent way by either a right or left handed user while the gun is held in firing position, e.g., by pressing on the end of the transverse sliding member with a tip of a index finger of the hand gripping the weapon. The transverse movement of the slider is very natural and easy when the gun held in the normal firing position. This is a particular feature of the present invention.

Having thus described the invention, those of skill in the art will appreciate that numerous modifications can be made from the arrangements illustrated for purposes of explanation without departing from the spirit of the present invention. For example, and not intended to be limiting, while the preferred embodiment is described as comprising two clamp portions each of which contains a recess with an insert therein, a useful clamp can be constructed with a recess in only one clamp portion. Further, while the preferred embodiment is described in terms of two U-shaped clamp portions, only one of the two clamp portions need have a U-shape, and either one or both portions of the clamp can contain a recess for an insert. Still further, while the use of recesses for retaining the inserts is illustrated, any mechanism for preventing transverse motion of the one or more inserts is useful. Any type of mating surface feature on the clamp portion and the insert which prevents relative lateral motion may be used. Still further, while the invented assembly is illustrated for convenience of explanation as being suitable for use with the trigger guard of a weapon, persons of skill in the art will understand based on the description herein that the invented assembly can be used with any rod or post or bar-like mounting structure or other mounting member to which it is desired to attach a light emitting module and is not limited merely to applications involving trigger guards of weapons. Accordingly, it is intended to include these and such other variations as will occur to those of skill in the art based on the description herein, in the claims that follow.

What is claimed is:

1. A light emitting module including a switching assembly, comprising:

a light emitting module selectively emitting a light beam in a first direction;

a base including a clamp adapted to affix said light emitting module to a weapon;

a battery; and a switch having a sliding member within the base, said switch incorporating contact means adapted to complete an electrical circuit between said battery and said light emitting module to actuate said light emitting module when said sliding member is moved in a second direction perpendicularly transverse to the first direction.

2. The assembly of claim 1 wherein said sliding member passes through said base in the second direction.

3. The assembly of claim 1 wherein said clamp comprises first and second detachably joined portions adapted to capture a weapon trigger guard therebetween to affix said base thereto.

4. The assembly of claim 1 wherein said sliding member has therein a center depression corresponding to an "off" said sliding member, flanked on at least one side by a further depression corresponding to an "on" position of said sliding member, and a spring loaded curved conductor which engages a selected one of said center depression and said further depression depending upon the position of said sliding member.

5. The assembly of claim 4 wherein said further depression is electrically conducting.

6. A laser sight, comprising:

a laser light emitting module for projecting a laser light beam in a first direction;

a clamp for attaching said laser sight to a weapon, wherein said clamp has a first portion for coupling to said laser light emitting module and a second portion for engaging a portion of the weapon;

a battery; and a slide switch actuation member passing through said first portion and having a motion in a second direction substantially perpendicular to the first direction to selectively close contacts and thereby selectively couple said battery to said laser light emitting module in a complete circuit.

7. The laser sight of claim 6 wherein a centered position of said actuation member corresponds to "off" and a non-centered position of said actuation member corresponds to "on", for selectively coupling said battery to said laser light emitting module.

8. The laser sight of claim 6 wherein an electrical circuit extends from said battery to a laser light source within said laser light emitting module through said actuation member when said actuation member is in a non-centered position.

9. The laser sight of claim 6 wherein said actuation member comprises at least one conducting region passing therethrough, said at least one conducting region being contacted by a spring loaded contact disposed within said first clamp portion when said actuation member is moved away from a centered position to thereby selectively establish said complete circuit through said at least one conducting region.

10. The laser sight of claim 6 further comprising first and second elastomeric inserts respectively disposed within said first and second clamp portions, said first and second elastomeric inserts lying one on either side of the portion of the weapon to which said clamp attaches.

11. A laser module mount with an integral switch, comprising:

a laser light emitting module selectively emitting a light beam in a first direction;

a clamp for affixing said laser light emitting module to a part of a weapon, said clamp comprising first and second detachably joined portions adapted to capture at least a portion of said part a weapon therebetween;

an insulating block in said clamp, said insulating block having a through-hole penetrating from a first face to a second face of said block and containing proximate said first face a central contact coupled to a power source for the light emitting module, and internally a partially compressed spring lying within said central through-hole and coupled to said central contact and at a distal end of said through-hole proximate said second face a movable contact extending from said through-hole, said movable contact and said central contact being coupled by said spring, said movable contact having an outer surface with a first radius of curvature protruding from said second surface of said block;

a sliding member passing through said clamp proximate said second surface of said insulating block in a second direction perpendicularly transverse the first direction, said sliding member having a central region with at least two depressions therein of a second radius of curvature like the first radius of curvature, wherein a first of said two depressions is insulating and a second of said two depressions is electrically conducting, so that when said sliding member is moved so as to place said movable contact in contact with said second depression, electrical continuity is established to provide power from said battery to said laser light emitting module.

12. The mount of claim 11 wherein said sliding member further comprises a third depression positioned adjacent said first depression such that said second and third depressions flank said first depression and said first depression is centrally located in the sliding member with said second and third depressions are located one on either side of said first depression, said third depression being electrically conductive whereby said first depression corresponds to a central "off" position of said sliding member and said second and third depressions correspond to alternatively selectably "on" positions of said sliding member.

13. The mount of claim 12 wherein said sliding member protrudes from said clamp, when in the "off" position, by less than about 0.050 inches.

14. The mount of claim 11 wherein said clamp further comprises recesses extending into said clamp where the sliding member penetrates said clamp.

* * * * *